US005374937A

United States Patent [19]

Tsunekawa et al.

[11] Patent Number: 5,374,937

[45] Date of Patent: Dec. 20, 1994

[54] RETRACTABLE ANTENNA SYSTEM

[75] Inventors: Koichi Tsunekawa; Atsuya Ando, both of Kanagawa, Japan

[73] Assignee: Nippon Telegraph and Telephone Corporation, Tokyo, Japan

[21] Appl. No.: 188,104

[22] Filed: Jan. 28, 1994

Related U.S. Application Data

[63] Continuation of Ser. No. 906,330, Jun. 30, 1992, abandoned.

[30] Foreign Application Priority Data

Jul. 8, 1991 [JP] Japan ..... 3-166868
Jul. 12, 1991 [JP] Japan ..... 3-172626

[51] Int. Cl.[5] ..... H01Q 1/24

[52] U.S. Cl. ..... 343/702; 343/895; 343/850

[58] Field of Search ..... 343/702, 895, 901, 906, 343/724, 725, 900, 752, 749, 850, 852, 853, 858, 860; H01Q 1/24, 1/50

[56] References Cited

U.S. PATENT DOCUMENTS

| | | | |
|---|---|---|---|
| 3,967,276 | 6/1976 | Goubau | 343/752 |
| 4,313,119 | 1/1982 | Garay et al. | 343/702 |
| 4,868,576 | 9/1989 | Johnson, Jr. | 343/702 |
| 4,958,382 | 9/1990 | Imanishi | 343/702 |
| 5,144,324 | 9/1992 | Chin et al. | 343/702 |
| 5,204,687 | 4/1993 | Elliott et al. | 343/900 |

FOREIGN PATENT DOCUMENTS

| | | | |
|---|---|---|---|
| 0301175 | 2/1989 | European Pat. Off. | 343/702 |
| 01-204504 | 9/1989 | Japan | H01Q 1/50 |
| 03-186001 | 8/1991 | Japan | H01Q 1/50 |

*Primary Examiner*—Donald Hajec
*Assistant Examiner*—Hoanganh Le
*Attorney, Agent, or Firm*—Nikaido, Marmelstein, Murray & Oram

[57] ABSTRACT

An antenna element (1) has a linear antenna rod (1*b*) of predetermined length and a top load (1*a*) *at the end of the rod* (1*b*). The antenna element (1) takes a first position in which the rod is extended out of a housing (8), and a second position in which the rod is retracted within the housing. There are provided two feed terminals (5, 6) along the rod (1*b*). The first feed terminal (5) is essentially matching the impedance of a node point in a current distribution in the resonant antenna element, and feeds the antenna element at the end of the rod in the first position. The second feed terminal (5) is matching the impedance of an anti-node point in a current distribution in the resonant antenna element, and feeds the antenna element at approximate center of the rod in the second position. A first feed terminal (5) might contact the rod in a second position, but it does not feed the same because of mismatching. Thus, the antenna system is always fed with matched condition whether it is extended or retracted, through the automatic switching of feed terminals.

16 Claims, 8 Drawing Sheets

RETRACTABLE ANTENNA SYSTEM

This application is a continuation of application Ser. No. 07/906,330 filed Jun. 30, 1992, now abandoned.

BACKGROUND OF THE INVENTION

The present invention relates to an antenna system, in particular, relates to a whip antenna which is used in a portable transceiver or a portable telephone set, which high gain of an antenna is obtained even when an antenna is retracted.

In a portable transceiver and/or a portable telephone set, it must operate even in a waiting state in order to receive a call, and therefore, an antenna must have high gain to receive a call. However, an antenna is usually retracted in a housing of a telephone set when a telephone set is in a waiting state. Therefore, it is desirable that an antenna has high gain not only when an antenna is extended, but also when an antenna is retracted.

In order to solve the above problem and have high gain in the antenna in retracted state, the U.S. Pat. No. 4,865,576 has been proposed. That antenna has an outside antenna rod which has a coil element at the bottom of the rod, a meander line type ground radiator, and a meander line antenna installed in a housing.

However, it has the disadvantages that the structure of the antenna is complicated, and the gain of an antenna when it is extracted is rather low, because of the relation from the coil and the meander line interfering with the radiation from the extended antenna rod, although the gain at retracted state is high by reason of those radiations.

SUMMARY OF THE INVENTION

It is an object of the present invention to overcome the disadvantages and limitations of a prior whip antenna system by providing a new and improved whip antenna system.

It is also an object of the present invention to provide a whip antenna system which is simple in structure, and has high gain in both the extended state and retracted state.

The above and other objects are attained by a retractable antenna system for a portable transceiver having a housing for holding an inner circuit and an antenna system connected with the inner circuit. The system comprises an essentially linear antenna element (1) having electrical length essentially the same as an integer multiple of a half wavelength of the operating frequency in the transceiver having a first position extended from the housing through an outlet of the housing and a second position in which most of the antenna element is retracted in the housing; a feed line (4) connected with output of the inner circuit; two feed terminals (5, 6) mounted in the housing along said antenna element so that a first feed terminal is located closer to the outlet of the housing than a second feed terminal; at least one matching circuit mounted in the housing and put between the feed line and the feed terminal to provide impedance matching between the feed line and the feed terminal contacted to the antenna element; a first feed terminal (5) being connected with a circuit having impedance which is almost the same as the impedance of the antenna element at a current node position in a resonant state, and a second feed terminal (6) being connected with a circuit having impedance which is almost the same as the impedance of the antenna system at a current anti-node position in a resonant state. In a first position of the antenna element, a first feed terminal contact with end of the antenna element at node point in current distribution. A second position of the antenna element a second feed terminal contacts with the antenna rod at anti-node point in current distribution.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 1A:
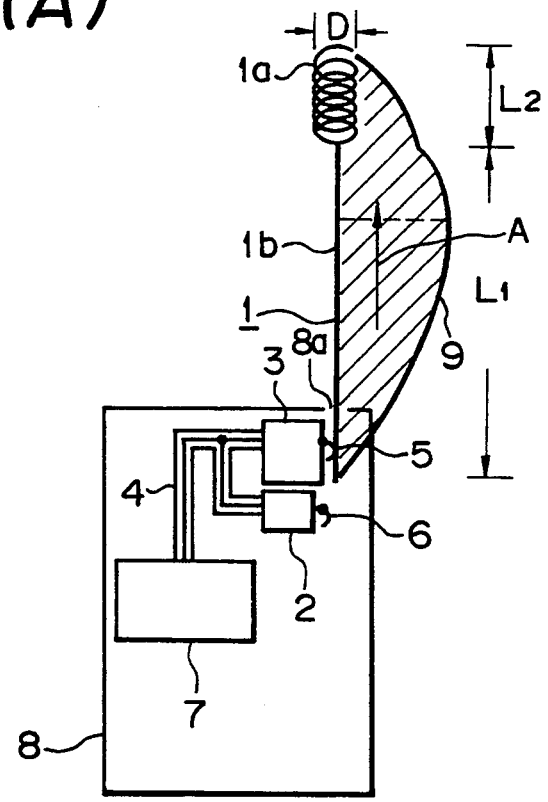
FIGS. 1A–1C show structure of the extractable antenna according to the present invention.
Figure 1B:
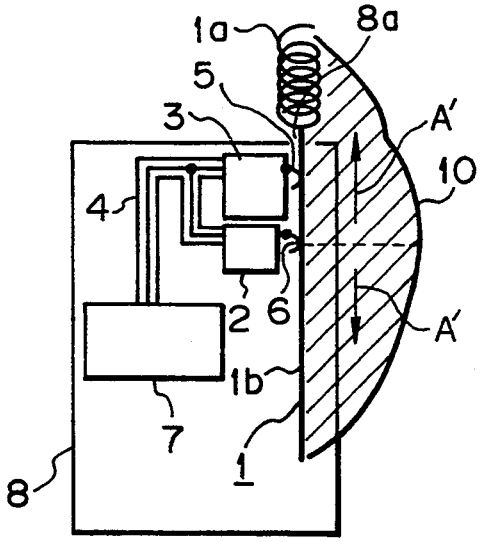

FIG. 1 shows an extendable antenna according to the present invention, in which FIG. 1A shows the antenna in extended state, and FIG. 1B show the antenna in retracted state. In the figures, the numeral 1 is a linear antenna element which has a linear antenna rod 1*b* with a top load 1*a* which is mounted at an extreme end of the rod 1*b* and coiled, 2 is a second matching circuit, 3 is a first matching circuit, 4 is a feed line, 5 is a first feed terminal, 6 is a second feed terminal, 7 is an inner circuit, and 8 is a housing which is usually conductive. The numeral 8*a* is an outlet provided on the housing, and through the outlet 8*a*, the antenna rod 1*b* is extended. The feed terminals 5 and 6 are located under the outlet 8*a* so that the first feed terminal 5 is located close to the outlet, and the second feed terminal 6 is located far from the outlet along the antenna rod 1*b*.

When an antenna is extended as shown in FIG. 1A, almost the whole body of the antenna rod 1*b* and the top load 1*a* are located outside of the housing 8. The bottom end of the antenna rod 1*b* contacts with the first feed terminal 5. When an antenna is retracted as shown in FIG. 1B, almost all of the antenna element is located inside of the housing 8, but preferably, only the top load 1*a* is located outside of the housing 8 and the linear rod 1*b* is located inside of the housing 8. In that retracted state, the second feed terminal 6 contacts with the antenna rod 1*b*, and the first feed terminal 5 might contact with the antenna rod 1*b*.

It is intended that the electrical length of the antenna element 1 with the top load 1*a* and the linear rod 1*b* is predetermined, and is preferably, approximate a half wavelength or an integer multiple of a half wavelength so that the antenna element resonates with the operation frequency.

The numerals 9 and 10 show the current distribution along the antenna element 1 in the extended state, and in the retracted state, respectively. The symbols A and A' show the current vectors in the current distribution.

It should be appreciated that the antenna system operates as a mono-pole antenna, whether or not the antenna element 1 is extended or retracted, because the current vector A, A' are directed to the ends of the antenna rod from the feed point in both cases.

When an antenna element 1 is extended as shown in FIG. 1A, the top load 1*a* and almost all of the antenna rod 1*b* of the linear antenna element 1 are located outside of the housing, and the antenna element 1 is fed at the first feed terminal 5. Since the electrical length of the antenna element 1 is a half wavelength, the current distribution 9 is obtained. The first matching circuit 3 functions to match the impedance of the antenna element at the current node point and the output impedance of the circuit 7. The second feed terminal 6 does not contact with the antenna element 1, and therefore, the second matching circuit and the second feed terminal do not affect the operation of the antenna. Also, the presence of the second matching circuit does not affect to the line impedance of the feed line 4, since the second matching circuit 2 is only very short open circuit connected parallel to the feed line 4. The electromagnetic wave is radiated by the whole length of the antenna rod and the top load.

When an antenna element 1 is retracted as shown in FIG. 1B, the antenna rod 1*b* is located inside of the housing 8, but the top load 1*a* is located outside of the housing 8. In this case, the second feed terminal 6 contacts the antenna rod 1*b* at the point which is electrically approximately a quarter wavelength from both the bottom and top of the antenna element and is the anti-node point of the antenna. Therefore, the antenna element is fed at the current anti-node point through the second matching circuit 2 and the second feed terminal 6, and radiates the electromagnetic wave. The second matching circuit 2 functions to match the impedance of the antenna element at the current anti-node point and the output impedance of the circuit 7. It should be noted that although the antenna rod is secured in the housing 8, the electromagnetic wave is radiated through the top load 1*a* which is located outside of the housing. In this case, the first feed terminal 5 might contact the antenna rod 1*b* at the point between the top and the center of the antenna rod. However as the impedance of the antenna element at that point does not match with the output impedance of the first matching circuit 3, the current distribution on the antenna element is not affected much by the first feed terminal. Therefore, the current distribution as shown by the numeral 10 is obtained, and the strong radiation is effected even when the antenna rod is retracted.

Figure 1C:
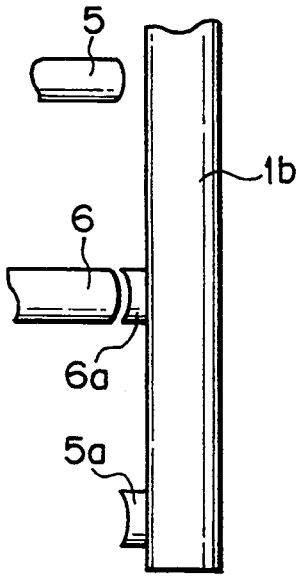

FIG. 1C shows an embodiment of an enlarged view of a part of the antenna rod 1*b*. The rod 1*b* has a first contact chip 5*a* and a second contact chip 6*a*. Those contact chips extend perpendicular to the longitudinal direction of the rod 1*b*, and have a concave surface as shown in the figure so that each chip engages with a convex end of a feed terminal 5 or 6. Because of the convex end of a feed terminal and a concave surface of a chip, they provide a snap fix of an antenna rod so that the first position and the second position of the antenna rod are clearly defined. The structure of FIG. 1C is advantageous in that the first feed terminal does not contact with the antenna rod 1*b* in the second position of the antenna rod 1*b*.

Now, some experimental results will be explained. It is provided in the experiment that the length $L_1$ of the antenna rod 1*b* is 80 mm, the length of the top load coil $L_2$ is 13 mm, the diameter D of the load coil 1*a* is 4 mm, the number of turns of the load coil 1*a* is 16. Further, the housing 8 has the size of 130 mm of height, 55 mm of width and 24 mm of thickness. The first matching circuit 3 is a type matching circuit, and no second matching circuit is provided as the output impedance of the circuit is 50Ω which matches with the antenna element at the current anti-node point.

Figure 2A:
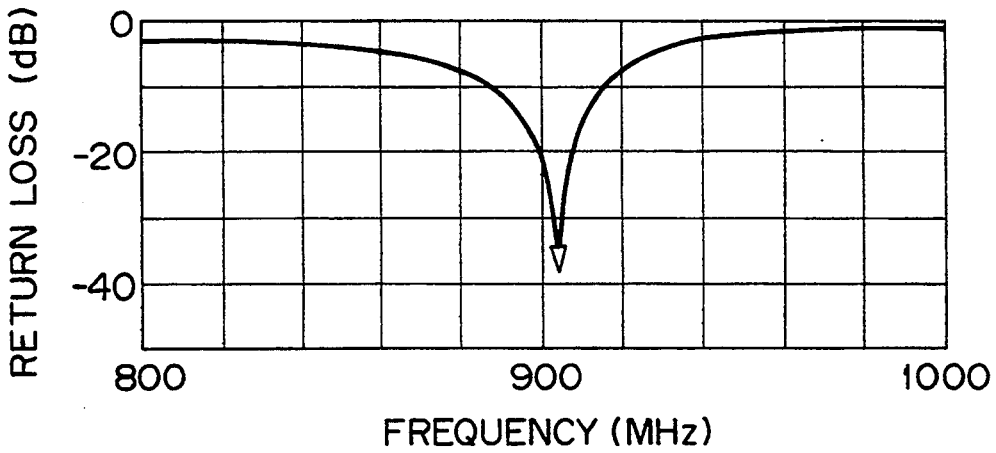
FIGS. 2A–2B show return loss characteristics curves of the antenna system in FIGS. 1A–1B, FIGS. 3A–3D show radiation pattern characteristics curves of the antenna system in FIG. 1, FIGS. 4A–4B show another embodiment of an extractable antenna according to the present invention.
Figure 2B:
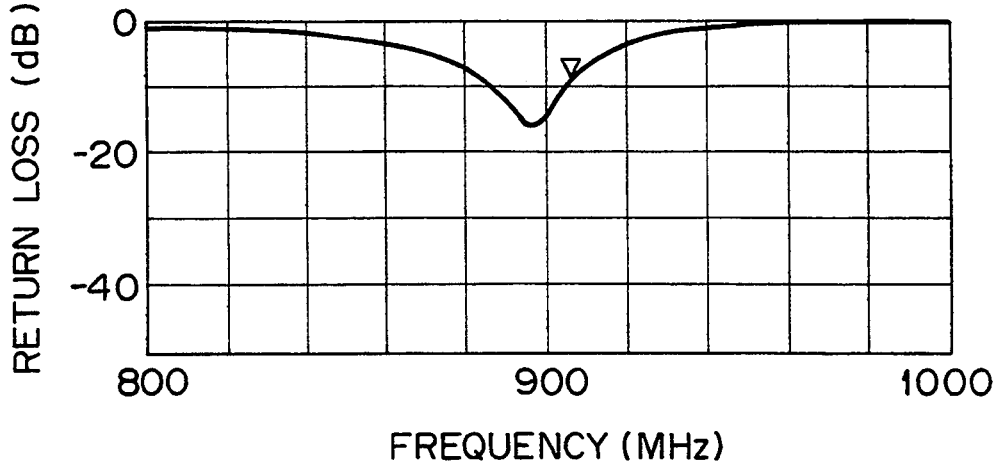
Figure 3A:
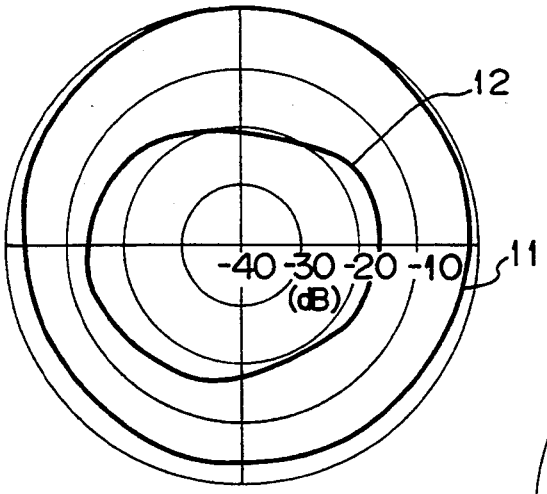
Figure 3B:
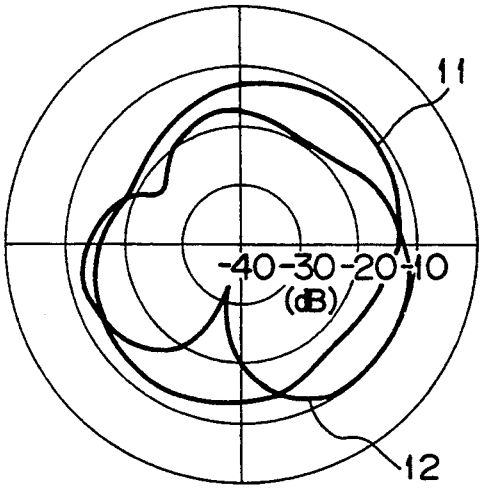
Figure 3C:
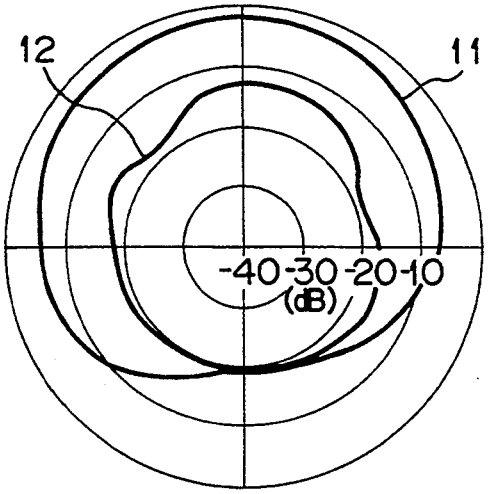
Figure 3D:
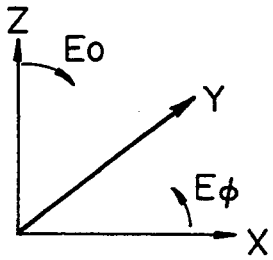

FIG. 2 shows the characteristics of return loss of the antenna in FIG. 1 when an antenna rod is extended (FIG. 2A). and when an antenna rod is retracted (FIG. 2B). In those figures, the horizontal axis shows frequency in MHz, and the vertical axis shows return loss in dB. As shown in FIG. 2A, when the antenna rod is extended, the resonant frequency is 904 MHz, and the return loss is −38 dB (VSWR<1.1). When the antenna rod is retracted, as shown in FIG. 2B, the resonant frequency is 893 MHz, and the return loss at 904 MHz is −9.5 dB (VSWR<2). The shift of the resonant frequency from 904 MHz to 983 MHz does not matter in the practical use of an antenna.

It should be appreciated in FIG. 2 that the return loss is sufficiently low both when an antenna rod is extended and when an antenna rod is retracted, and that sufficient power is supplied to an antenna even when an antenna rod is retracted.

FIG. 3 shows the experimental result of the radiation pattern in the horizontal (Y—Y) plane when an antenna element stands vertically (along Z axis). The reference of these patterns (0 dB) is a maximum level of a half wavelength dipole antenna. FIG. 3A shows the radiation pattern when an antenna rod is extended, FIG. 3B shows the radiation pattern of an antenna which has no second feed terminal and with the antenna rod retracted. FIG. 3B does not belong to the present invention, and the antenna rod is always fed through the first feed terminal. FIG. 3C shows the radiation pattern of the present antenna in the retracted state. The numeral 11 shows $E_\Theta$ component, and the numeral 12 shows $E_\phi$ component.

It should be appreciated that the present antenna radiates (FIG. 3A and FIG. 3C) strongly both in the extended state and retracted states. On the other hand, if no second feed terminal is provided (FIG. 3B) the radiation characteristics in the retracted state is considerably deteriorated. Assuming that the average level of the radiation pattern shows an antenna gain, the antenna gain as compared with a half wavelength dipole antenna is −1 dB in FIG. 3A, −13 dB in FIG. 3B, and −4.5 dB in FIG. 3C. Thus, it should be noted that the excellent radiation pattern is obtained even when an antenna rod is retracted in the present invention.

Figure 4A:
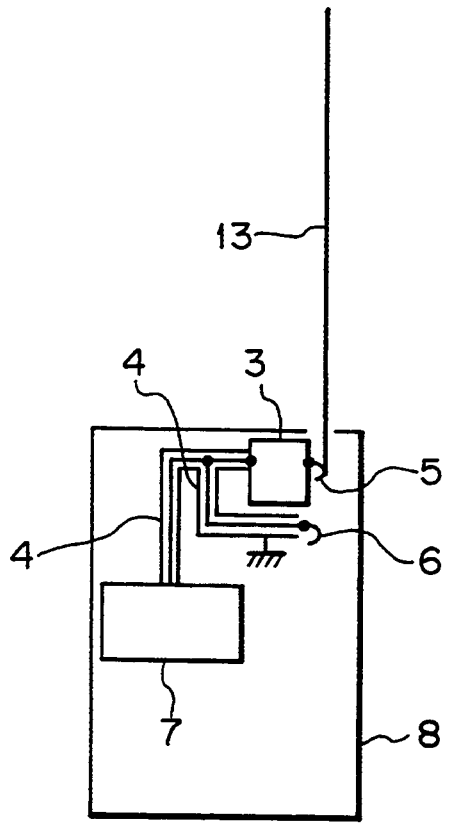
Figure 4B:
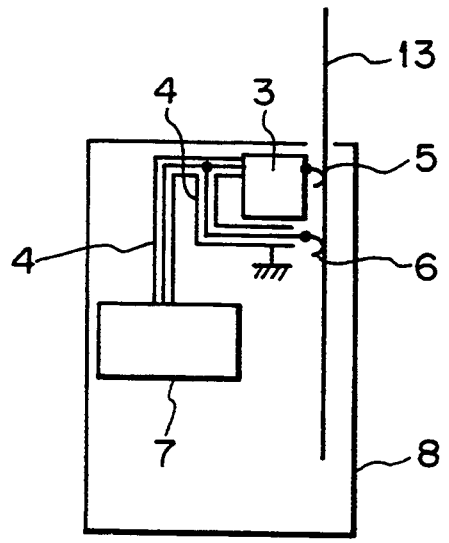

FIG. 4 shows the modification of the antenna of the present invention. The feature of FIG. 4 is that no top load is provided. The same numerals as those in FIG. 1 show the same members, and the numeral 13 shows a linear antenna rod of a half wavelength. FIG. 4A shows the extended state, and FIG. 4B shows the retracted state. When the rod is retracted, the antenna rod is fed at the center of the rod by the second feed terminal 6, and a portion of the antenna rod which is located outside of the housing 8 functions for radiation.

Figure 5A:
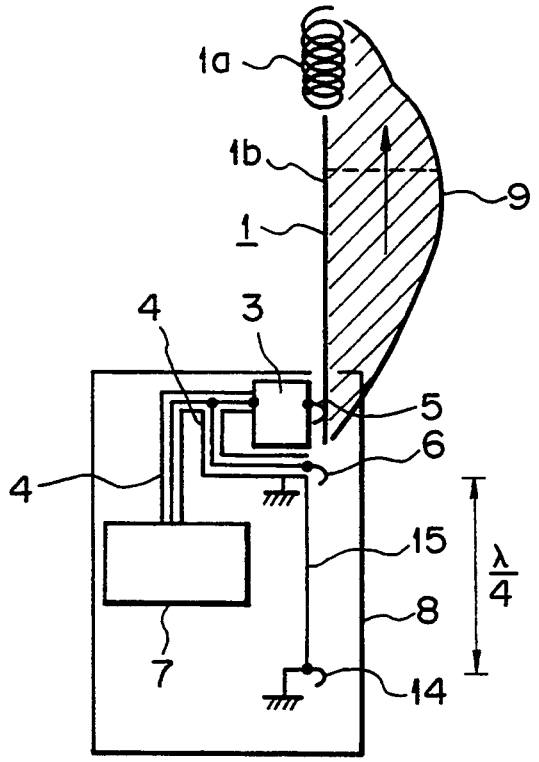
FIGS. 5A–5C show still another embodiment of an extendable antenna according to the present invention.
Figure 5B:
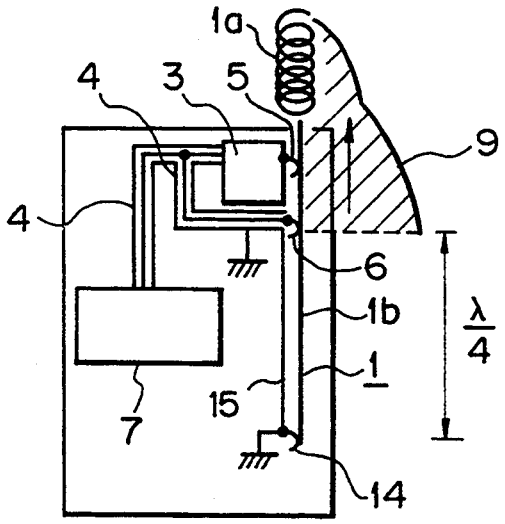

FIG. 5 shows another embodiment of the antenna system according to the present invention. FIG. 5A shows the extended state, and FIG. 5B shows the retracted state. The same reference numerals as those in FIG. 1 show the same members. The numeral 14 is a third terminal, and 15 is a linear conductor extending between the second feed terminal 6 and the third terminal 14, located parallel and close to the antenna rod 1*b* in the retracted state.

The operation of the antenna system in the FIG. 5 in extended state is the same as that of FIG. 1, and the current distribution 9 in FIG. 5A is the same as that in FIG. 1A. On the other hand, when an antenna rod 1*b* is retracted, the bottom point of the antenna rod 1*b* contacts with the third terminal 14 which grounds the end of the antenna rod 1*b*. Therefore, at the second feed terminal 6, the lower portion of the antenna rod 1*b* together with the adjacent parallel conductor 15 is essentially a balanced pair cable of a quarter wavelength with the end short-circuited. It should be noted in academic theory that a balanced pair cable of a quarter wavelength with an end short-circuited or grounded has infinite impedance. As the impedance of the antenna rod 1*b* in the lower portion is infinite, the current on the antenna system flows only in the upper portions, and the current distribution on the antenna system is shown by the numeral 16 in FIG. 5B. No current flows in the lower half portion of the antenna rod.

Thus, it should be appreciated that an antenna in FIG. 5 is a half wavelength antenna in the extended state, and is essentially a quarter wavelength antenna in the retracted state. The antenna system of FIG. 5 has the advantage that no deterioration of characteristics of an antenna happens even when a conductive housing 8 is positioned close to an antenna rod 1*b*.

Figure 5C:
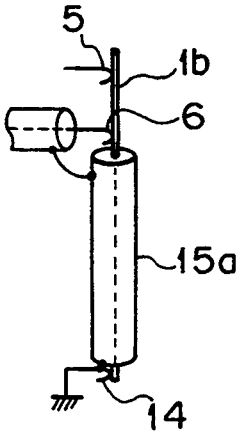

As a modification as shown in FIG. 5C, the linear conductor 15 may be replaced by a hollow conductive cylindrical tube 15*a* in which the rod 1*b* is movably inserted, and the third contact 14 is provided at the bottom of the tube. In this case, the hollow tube and the antenna rod make a short-circuited quarter wavelength coaxial cable, and the operation of this case is the same as FIG. 5B.

Figure 6:
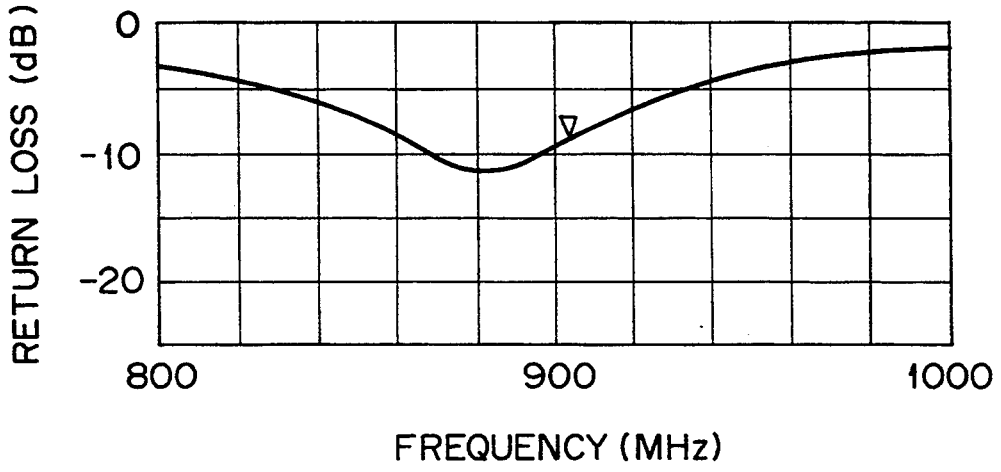
FIG. 6 shows return loss characteristic curve of the antenna system of FIG. 5.

FIG. 6 shows the experimental result of the return loss characteristics of the antenna system in FIG. 5 in retracted state. The structure of a transceiver and an antenna ms the same as that in FIG. 1, but the bottom of the antenna rod is grounded in the retracted state. The conductive line 15 is implemented by a conductive housing 8 by locating the antenna rod 1*b* close to the wall of the housing so that the spacing of the antenna rod and the housing wall is about 2 mm. The horizontal axis in FIG. 6 shows frequency in MHz and the vertical axis shows return loss in dB.

It should be noted in FIG. 6 that the antenna resonates even when it is retracted although the resonant frequency is a little shifted from the resonant frequency 904 MHz in extended state. And, the return loss at the frequency 904 MHz which is the resonant frequency in extended state is −8 dB. The radiation characteristics of the antenna system in FIG. 5 are excellent as it resonates both in extended state and retracted state.

It should be appreciated of course that some modifications are possible to a person ordinary skilled in the art. For instance, although a half wavelength linear antenna is described, an antenna with a length of an integer multiple of half wavelength is possible in the present invention.

FIG. 7 shows some examples of a top load of the antenna system in FIG. 1, FIG. 4 or FIG. 5.

Figure 7C:
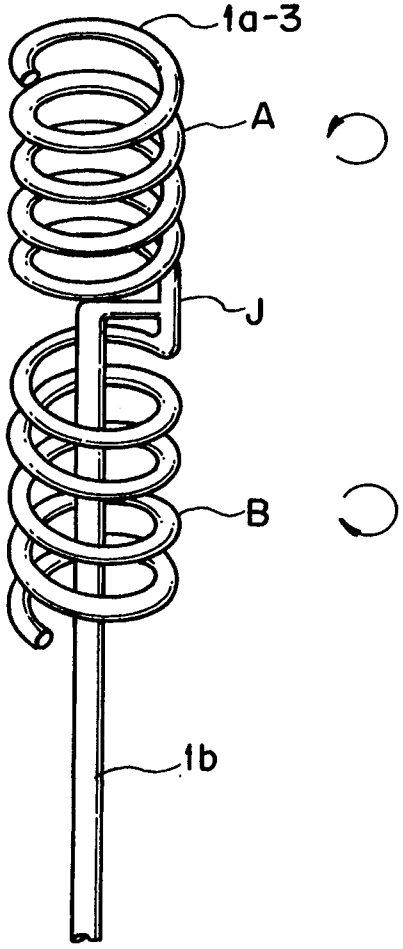
FIGS. 7A–7C show some modifications of a top load.
Figure 7B:
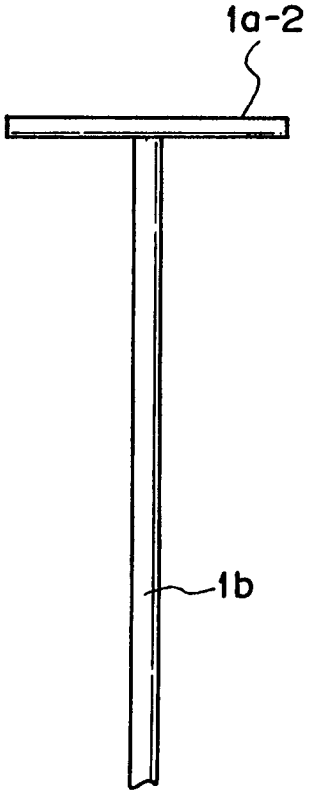
Figure 7A:
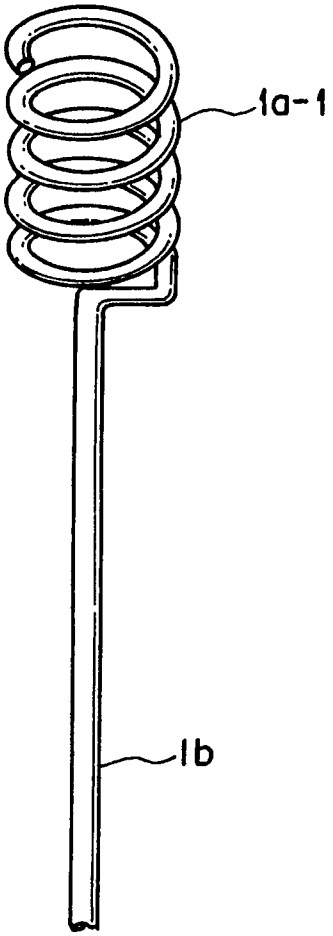

FIG. 7*a* shows a coil 1*a*-1 as a top load 1*a*. The coil 1*a*-1 is mounted at the extreme end of the rod 1*b* so that the axis of the coil 1*a*-1 coincides essentially with the longitudinal direction of the antenna rod 1*b*. The coil 1*a*-1 has several turns depending upon the desired resonant frequency of the antenna system, while winding direction does not matter. One end of the coil 1*a*-a is connected to the end of the rod 1*b*, and the other end of the coil is free standing.

FIG. 7B shows a flat circular disc 1*a*-2 as a top load. The disc 1*a*-2 is mounted at the extreme end of the rod 1*b* so that the disc plane is perpendicular to the longitudinal direction of the rod 1*b*.

FIG. 7C shows a coil load 1*a*-3 which has a pair of coils A and B. The coils A and B has a common axis, which coincides essentially with the longitudinal direction of the rod 1*b*. The coils A and B are wound in opposite direction with each other so that when the coil A is wound in the counter-clockwise direction, the coil B is wound in clockwise direction and vice versa. The junction J of two coils A and B is connected electrically with the extreme end of the rod 1*b*, with the other ends of the coils being free standing.

The feature of the modification of FIG. 7C which has two coils is that the antenna system has two resonant frequencies. The first resonant frequency of the antenna system is essentially defined by the first coil A and the rod 1*b*, and the second resonant frequency is essentially defined by the second coil B and the rod 1*b*. Each of the resonant frequencies maybe adjusted by designing number of turns of each coil.

It should be appreciated that coils A and B which are wound in opposite directions with each other have low mutual couplings with each other, in spite of the close positioning of those coils. In other words, when a first resonant frequency is adjusted by changing the number of turns of the coil A, the second resonant frequency which is defined by the coil B and the length of the rod is not determined by the resonant frequency by the coil A.

As the modification of FIG. 7C has two resonant frequencies, it is advantageous to use it in a transceiver or a portable telephone set which uses a different transmitting frequency from its receiving frequency.

As a modification of FIG. 7C, two coils may be mounted on the rod 1*b* so that the axis of the coils is perpendicular to the longitudinal direction of the rod 1*b*.

FIG. 8 shows an embodiment of a matching circuit 3 in each of the previous embodiments. It is assumed in FIG. 8 that the second matching circuit 2 is not necessary as the characteristic impedance of a feed line 4 (for instance it is 50Ω) is almost matched with the impedance of the antenna system 1 at the anti-node so that the VSWR is less than 2.

Figure 8B:
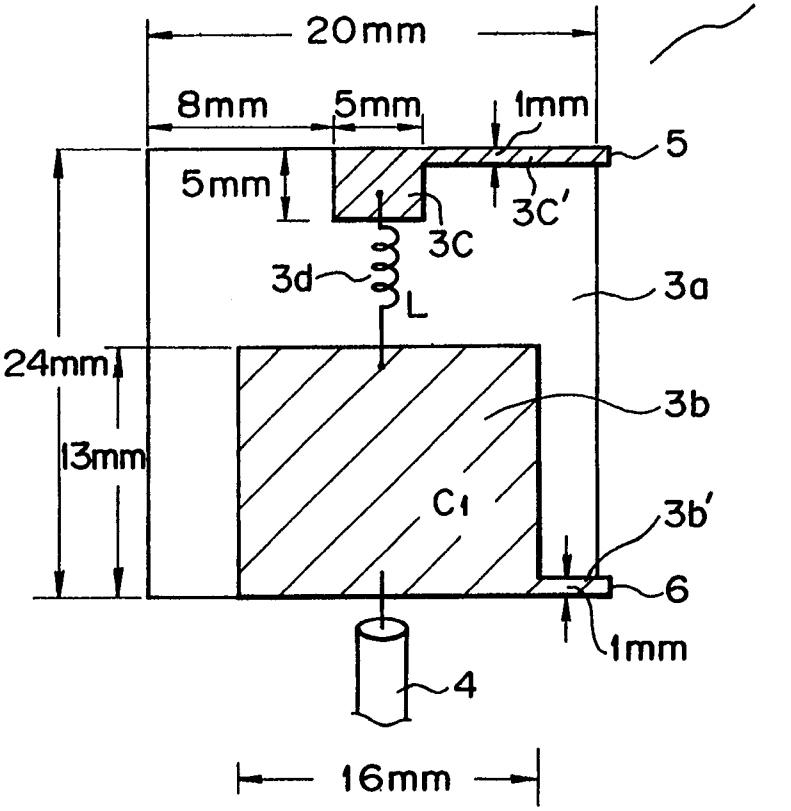
FIGS. 8A–8B show an embodiment of a matching circuit.
Figure 8A:
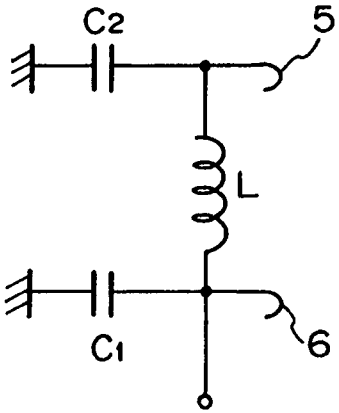

FIG. 8A shows an equivalent circuit of the matching circuit which is a -type matching circuit having a pair of capacitors $C_1$ and $C_2$, and an inductor L.

FIG. 8B shows an example of a plane view of the matching circuit 3 which has a dielectric flat substrate 3*a* of the size of 20 mm×24 mm and the thickness of 1 mm. The conductive patterns 3*b* of 13 mm×16 mm, and 3*c* of 5 mm×5 mm are deposited on the substrate. The matching circuit of FIG. 8B is attached on the surface of the housing so that the spacing of 1 mm is provided between the conductive housing and the conductive patterns, so that the patterns 3*b* and 3*c* provide the capacitance $C_1$ and $C_2$, respectively. A coil 3*d* which functions as inductance L which has three turns with the diameter of 1.6 mm couples the patterns 3*b* and 3*c*. A thin strip 3*b* deposited on the substrate extends from the pattern 3*b* to the end of the substrate so that the end of the strip 3*b*′ operates as a contact 5 which contacts with the antenna rod. Similarly, the end of a thin strip 3*c*′ extending from the pattern 3*c* operates as the feed contact 6. The width of the strips is for instance 1 mm. A feed line 4 which is a coaxial cable is connected with the pattern 3*b* with the inner conductor of the cable soldered to the pattern 3*b* and the outer conductor of the same grounded (i.e., with the surface of the metal housing).

From the foregoing it will now be apparent that a new and improved retractable antenna system has been found. It should be understood of course that the embodiments disclosed are merely illustrative and not intended to limit of the invention. Reference should be made to the appended claims, therefore, for indicating the scope of the invention.

What is claimed is:

1. A retractable antenna system for a portable transceiver having a housing for holding an inner circuit and an antenna system connected with said inner circuit, comprising:

an essentially linear antenna element having an electrical length essentially the same as an integer multiple of a half wavelength of an operating frequency of the transceiver, said antenna element having a first position extended from the housing through an outlet thereof and a second position in which most of a length of the antenna element is restricted in the housing;

a feed line connected with an output of the inner circuit;

two feed terminals set in the housing along said antenna element so that a first feed terminal is located closer to the outlet of the housing than a second feed terminal; and at least one matching circuit mounted in the housing and operatively located between said feed line and one of said feed terminals so as to provide impedance matching between said feed line and a corresponding feed terminal contacted to said antenna element, wherein said matching circuit has a predetermined matching impedance that comprises a first impedance which is almost the same as an impedance of a current node point on said resonant antenna element when said first feed terminal is connected with said matching circuit, and comprises a second impedance which is almost the same as an impedance of a current anti-node point on said resonant antenna element when the second feed terminal is connected with said matching circuit, in the first position of the antenna element, said first feed terminal matching with the node point in a current distribution of said resonant antenna element, in the second position of the antenna element, said second feed terminal matching with the anti-node point in a current distribution of said resonant antenna element.

2. An antenna system according to claim 1, wherein said antenna element has an elongated antenna rod, and a conductive top load at an outer extreme end of the antenna rod, and the top load is located outside of the housing in the second position of said antenna element.

3. An antenna system according to claim 2, wherein the top load is a coil with an axis essentially coinciding with a longitudinal direction of the antenna rod.

4. An antenna system according to claim 2, wherein the top load is a flat conductive plate mounted at an extreme end of the antenna rod.

5. An antenna system according to claim 2, wherein the top load has first and second coils connected in series with each other so that a junction of the first and second coils is connected to the outer extreme end of the antenna rod, and a winding direction of the first coil is opposite a winding direction of the second coil.

6. An antenna system according to claim 1, further comprising:

a conductive linear means extending from a minus terminal of said second feed terminal along the antenna rod, the antenna rod and said conductive linear means making a balanced pair cable with an electrical length approximately a quarter wavelength of the operating frequency on the transceiver; and a third feed terminal which is connected to said conductive linear means and grounded, said third feed terminal being operatively positioned so as to contact an inner extreme end of the antenna rod when in the second position.

7. An antenna system according to claim 6, wherein said conductive linear means is a hollow cylindrical tube, and the antenna rod and said hollow tube operate as a coaxial cable.

8. An antenna system according to claim 1, wherein said antenna rod has a chip for engaging with at least one of said first and second feed terminals, the chip and each of said feed terminals having defined thereon a concave surface and a convex surface, respectively, for engagement with each other so as to have a snap connection of the antenna rod.

9. A retractable antenna system for a portable transceiver, comprising:

a housing for holding an inner circuit;

a linear antenna element having an electrical length substantially equal to an integer multiple of a half wavelength of an operating frequency of the transceiver, said antenna element having a first extended position from said housing through an outlet thereof and a second retracted position in which most of a length of said antenna element is retracted into said housing;

a feed line connected with an output of the inner circuit;

first and second feed terminals positioned in said housing along said antenna element so that the first feed terminal is located closer to the outlet of said housing than the second feed terminal; and first and second matching circuits mounted in said housing and operatively located between said feed line and said first and second feed terminals, respectively, so as to provide impedance matching between said feed line and a corresponding feed terminal in contact with said antenna element, wherein said first matching circuit includes a first predetermined matching impedance that comprises a first impedance substantially equal to an impedance of a current node point on said antenna element when resonant in the first extended position of the antenna element when said first feed terminal is connected with said first matching circuit, and said second matching circuit includes a second predetermined matching impedance that comprises a second impedance substantially equal to an impedance of a current anti-node point on said antenna element when resonant in the second retracted position of the antenna element when said second feed terminal is connected with said second matching circuit.

10. An antenna system according to claim 9, wherein said antenna element includes an elongated antenna rod, and a conductive top load at an outer end of the antenna rod, the top load being located outside of said housing in the second position of said antenna element.

11. An antenna system according to claim 10, wherein the top load is formed as a coil with an axis concentric with a longitudinal direction of the antenna rod.

12. An antenna system according to claim 10, wherein the top load is formed as a flat conductive plate mounted at the outer end of the antenna rod.

13. An antenna system according to claim 10, wherein the top load has first and second coils connected in series with each other so that a junction of the first and second coils is connected to the outer end of the antenna rod, and a winding direction of the first coil is opposite a winding direction of the second coil, and further an axis of the first and second coils is concentric with the longitudinal direction of the antenna rod.

14. An antenna system according to claim 9, further comprising:

a conductive linear means extending from a minus terminal of said second feed terminal along the antenna rod, the antenna rod and said conductive linear means forming a balanced pair cable with an electrical length approximately a quarter wavelength of the operating frequency on the transceiver; and a third feed terminal which is connected to said conductive linear means and to ground, said third feed terminal being operatively positioned so as to contact an inner end of the antenna rod when in the second position.

15. An antenna system according to claim 14, wherein said conductive linear means is a hollow cylindrical tube, and the antenna rod and said hollow tube operate as a coaxial cable.

16. An antenna system according to claim 9, wherein said antenna rod has a chip for engaging with at least one of said first and second feed terminals, the chip and each of said feed terminals having defined thereon a concave surface and a convex surface, respectively, for engagement with each other so as to have a snap connection of the antenna rod.

* * * * *

UNITED STATES PATENT AND TRADEMARK OFFICE

CERTIFICATE OF CORRECTION

PATENT NO. : 5,374,937

DATED : December 20, 1994

INVENTOR(S) : Koichi TSUNEKAWA et al.

It is certified that error appears in the above-identified patent and that said Letters Patent is hereby corrected as shown below:

Title page, Item [73], continue with:

-- NTT Mobile Communications Network, Inc., Tokyo, Japan --.

Signed and Sealed this

Seventh Day of May, 1996

*Attest:*

Bruce Lehman

BRUCE LEHMAN

*Attesting Officer*

*Commissioner of Patents and Trademarks*